US007021853B2

(12) United States Patent
Hall et al.

(10) Patent No.: US 7,021,853 B2
(45) Date of Patent: Apr. 4, 2006

(54) BODY WITH OUTER DETACHABLE POUCH

(75) Inventors: Lindsay R. Hall, Centerville, OH (US); Thomas J. Africa, Lebanon, OH (US); Mark R. Stockstill, Dayton, OH (US)

(73) Assignee: MeadWestvaco Corporation, Stamford, CT (US)

( * ) Notice: Subject to any disclaimer, the term of this patent is extended or adjusted under 35 U.S.C. 154(b) by 146 days.

(21) Appl. No.: 10/651,762

(22) Filed: Aug. 29, 2003

(65) Prior Publication Data

US 2005/0046173 A1 Mar. 3, 2005

(51) Int. Cl.
*B42D 3/00* (2006.01)

(52) U.S. Cl. ..... 402/73; 206/232; 206/450; 206/308.1; 206/472; 281/15.1; 281/29; 281/31; 281/34; 402/73; 402/80 R; 402/502

(58) Field of Classification Search ..... 281/29, 281/31, 34, 15.1; 402/73, 502, 80 R; 206/232, 206/450, 472, 308.1
See application file for complete search history.

(56) References Cited

U.S. PATENT DOCUMENTS

| | | | | |
|---|---|---|---|---|
| 124,961 | A | 3/1872 | Keech | |
| 818,202 | A | 4/1906 | Sweet | |
| 1,218,849 | A * | 3/1917 | Frederickson | 206/81 |
| 2,677,376 | A | 5/1954 | Brunner | |
| 3,620,552 | A | 11/1971 | Woodcock et al. | |
| 4,058,327 | A | 11/1977 | Sullivan et al. | |
| D273,796 | S | 5/1984 | Milden | |
| D303,809 | S | 10/1989 | Klein | |
| 4,961,596 | A | 10/1990 | Moor | |
| 5,042,841 | A | 8/1991 | Friedman | |
| 5,240,340 | A * | 8/1993 | Lynch et al. | 402/79 |
| D344,096 | S * | 2/1994 | Tan | D19/26 |
| 5,294,208 | A | 3/1994 | Tremmel, Jr. et al. | |
| 5,378,022 | A * | 1/1995 | French et al. | 281/31 |
| 5,405,010 | A * | 4/1995 | Goldberger | 206/5 |
| 5,489,021 | A * | 2/1996 | Wallingford | 206/214 |
| D378,685 | S * | 4/1997 | French et al. | D19/33 |
| 5,682,730 | A | 11/1997 | Dobreski | |
| D415,196 | S | 10/1999 | Moor | |
| D418,161 | S | 12/1999 | Tell | |
| 6,017,062 | A | 1/2000 | White | |
| 6,024,508 | A | 2/2000 | Lippeth et al. | |
| 6,095,564 | A | 8/2000 | Wien | |
| 6,161,979 | A | 12/2000 | Yamamoto et al. | |
| 6,241,414 | B1 * | 6/2001 | Wien | 402/73 |
| 6,250,834 | B1 | 6/2001 | Wien | |
| D451,273 | S | 12/2001 | Moor et al. | |
| 6,367,842 | B1 | 4/2002 | Wien et al. | |

* cited by examiner

*Primary Examiner*—Boyer D. Ashley
*Assistant Examiner*—Mark Henderson
(74) *Attorney, Agent, or Firm*—Thompson Hine LLP

(57) ABSTRACT

A body and pouch combination including a body having a front cover and a rear cover pivotally coupled together. The front cover has a generally flat, planar outer surface having a body attachment structure located thereon. The combination includes a pouch that can cooperate with the body attachment structure to removably attach the pouch to the outer surface, the pouch having an inner storage cavity.

27 Claims, 8 Drawing Sheets

BODY WITH OUTER DETACHABLE POUCH

The present invention is directed to a body and pouch combination, and more particularly to a body and pouch combination wherein the pouch is releasably attachable to an outer surface of the body.

BACKGROUND

Various school and office products, such as notebooks, binders, folders and the like are commonly used by students and professionals for carrying papers, handouts, and other loose items. Such notebooks, binders and folders are typically used in conjunction with writing instruments and other loose items. Although various pouches for carrying such loose items may be utilized, such pouches can be easily separated from the notebook, binder or folder. Furthermore, if the pouch is attached to an inner surface of the notebook, binder or folder, it may be difficult to access the pouch. Accordingly, there is a need for a system for attaching a pouch to the outer surface of a body.

SUMMARY

The present invention is a body and pouch combination wherein the pouch can cooperate with an attachment structure located on an outer surface of the body to removably attach the pouch to the outer surface. Accordingly, because the pouch is attached to an outer surface thereof, the pouch may be able to be easily accessed.

In one embodiment, the invention is a body and pouch combination including a body having a front cover and a rear cover pivotally coupled together. The front cover has a generally flat, planar outer surface having a body attachment structure located thereon. The combination includes a pouch that can cooperate with the body attachment structure to removably attach the pouch to the outer surface, the pouch having an inner storage cavity. Other objects and advantages of the present invention will be apparent from the following description and the accompanying drawings.

DETAILED DESCRIPTION

Figure 1:
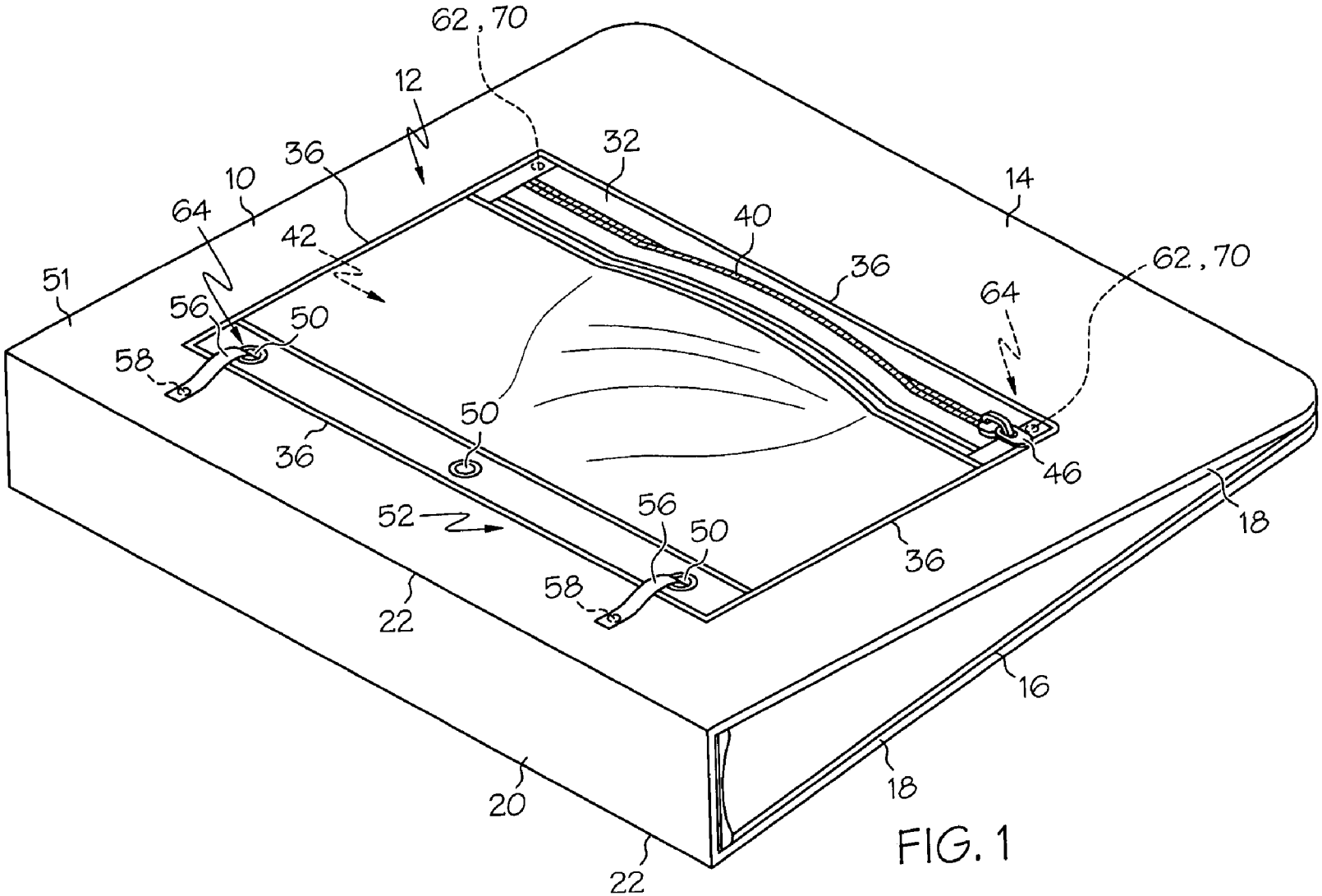
FIG. 1 is a front perspective view of a binder with a pouch releasably coupled thereto, with the binder in its closed position.
Figure 3:
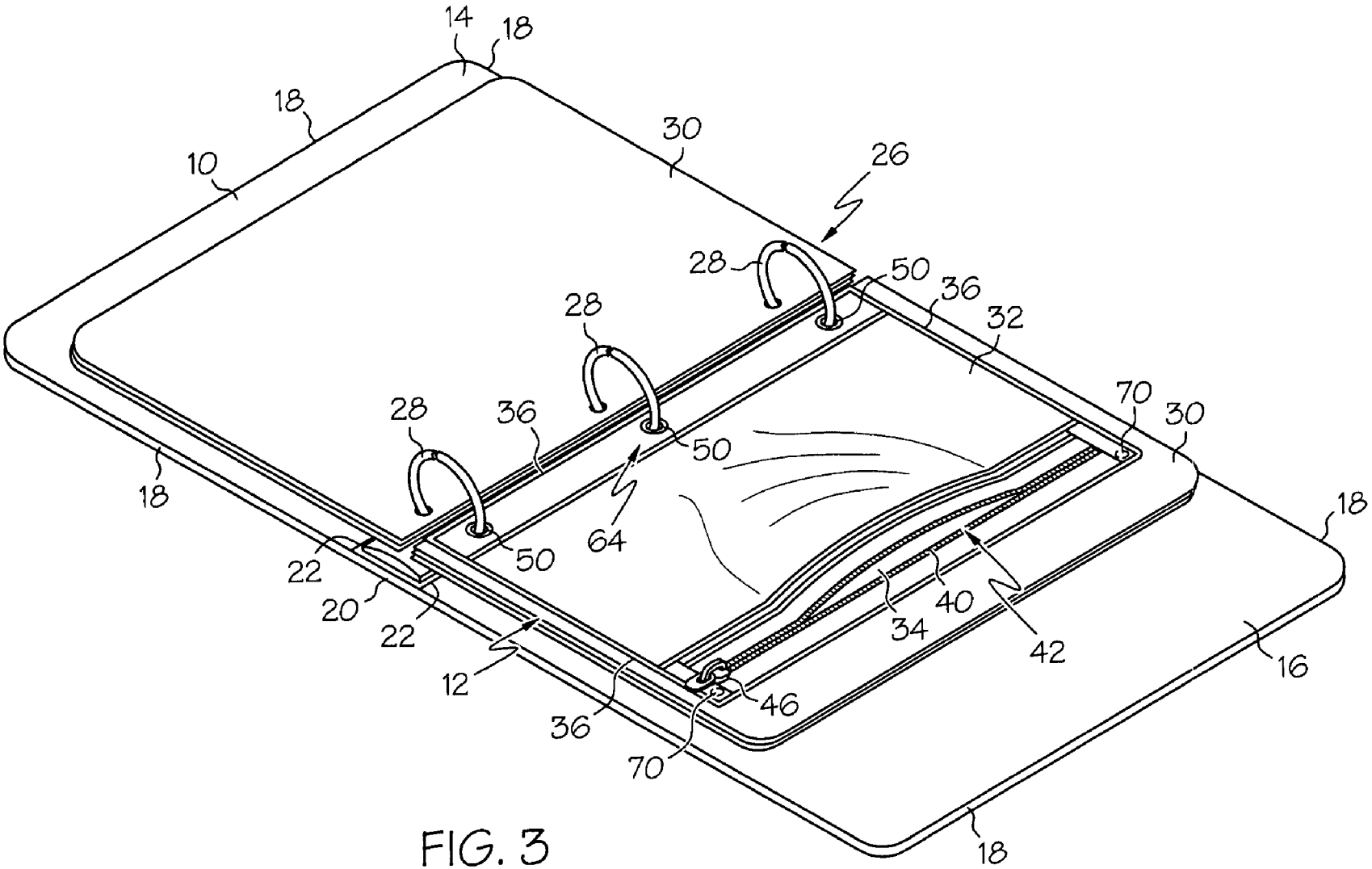
FIG. 3 is a front perspective view of the binder and pouch of FIG. 1, with the binder in its open position and the pouch coupled to the binding mechanism of the binder of FIG. 1.

As shown in FIGS. 1 and 3, in one embodiment the combination of the present invention may include a binder, or body 10, and a pouch 12 releasably attached thereto. The binder 10 may include front 14 and rear 16 covers pivotally coupled together and each cover 14, 16 may have an outer perimeter or periphery 18. The binder 10 may include a spine 20 interposed between the front 14 and rear 16 covers, with each of the front 14 and rear 16 covers being pivotally coupled to the spine 20.

Each of the front 14 and rear 16 covers may be generally flat, planar and rectangular in front view and include an inner edge 22 which is coupled to the spine 20. The front 14 or rear 16 cover may include a pocket on an inner surface thereof for storing loose papers and the like. The binder 10 may be movable between a closed position (FIG. 1) wherein the front 14 and rear 16 covers are generally aligned, parallel and facing each other, and an open position (FIG. 3) when the front 14 and rear 16 covers are generally not facing each other, of and/or are not generally aligned, and/or are not generally parallel.

As shown in FIG. 3, the binder 10 may include a binding mechanism 26 coupled to an inner surface thereof. In the illustrated embodiment, the binding mechanism 26 is a three-ring binder including a set of three rings 28. Each ring 28 may include a pair of a ring components or prong components which are separable from the other associated ring or prong component in the standard manner such that papers 30 and other items can be located in the binding mechanism 26. However, a wide variety of binding mechanisms 26 besides the three-ring binding mechanism shown herein may be utilized without departing from the scope of the invention, such as a prong binding mechanism including generally flexible or pliable prongs, adhesive binding mechanisms, gripping binding mechanisms, and the like.

Figure 4:
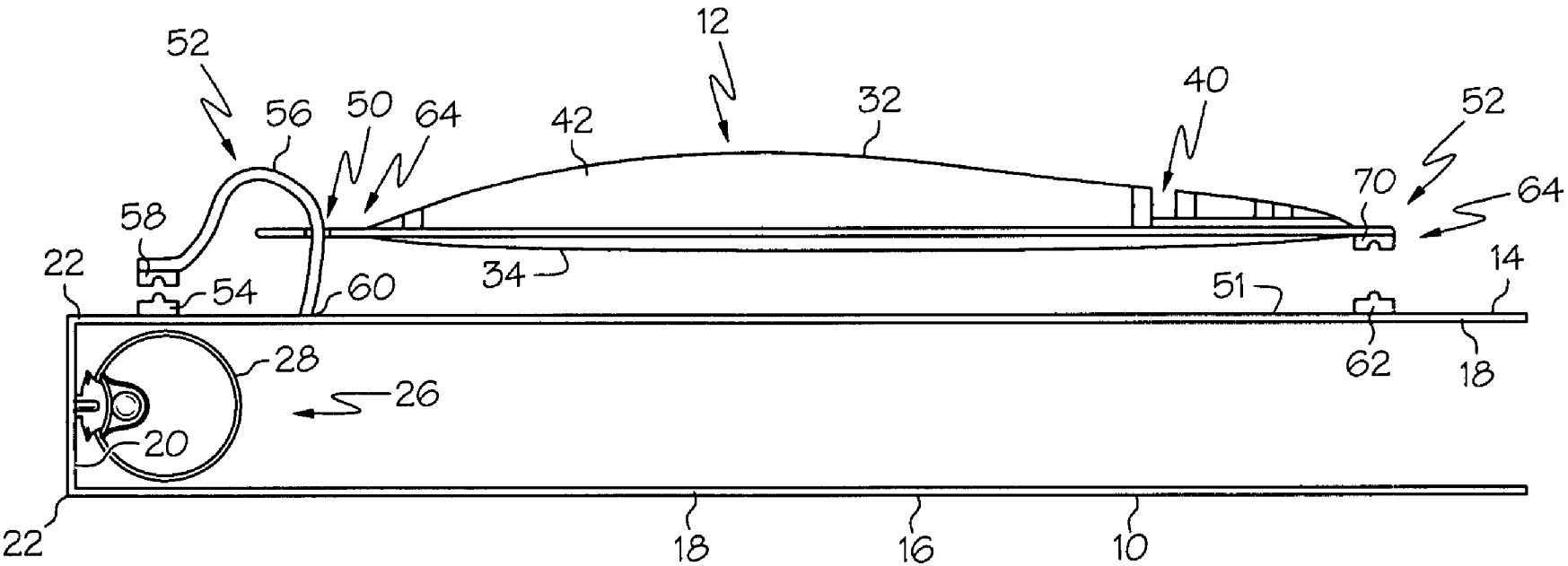
FIG. 4 is a side cross section of the binder and pouch of FIG. 1, with the pouch slightly spaced away from the binder.

As shown in FIGS. 3 and 4, the pouch may include a front panel or cover 32 and a rear panel or cover 34. As shown in FIG. 1, the pouch 12 may have a surface area in front view equal to about 50% of the surface area of the front cover 14 of the binder 10, and in another embodiment has a surface area greater than about one quarter of the surface area of the front cover 14 of the binder 10. Each of the front 32 and rear 34 panels may be made of a generally flexible flat sheet-like material and may be directly coupled together about their peripheries 36 to define an inner cavity 42 therebetween. The pouch 12 may include an access opening 40, such as a slit formed in the front panel 32, to provide access to the inner cavity 42 of the pouch 12. The pouch 12 may also include a closure mechanism or fastener 46, such as a zipper, slide fastener, hook and loop attachment system (such as VELCRO®) and the like for selectively opening and closing the access opening 40.

The pouch 12 may include a set of openings 50 located along or adjacent to an inner edge thereof. As shown in FIG. 3, the openings 50 may be sized and located to align with the rings 28 of the three-ring binding mechanism 26 such that a ring 28 of the binding mechanism 26 can be passed through each of the openings 50 to thereby couple the pouch 12 to the binding mechanism 28 and binder 10. Each opening may include a grommet to protect and strengthen the opening 50.

Figure 2:
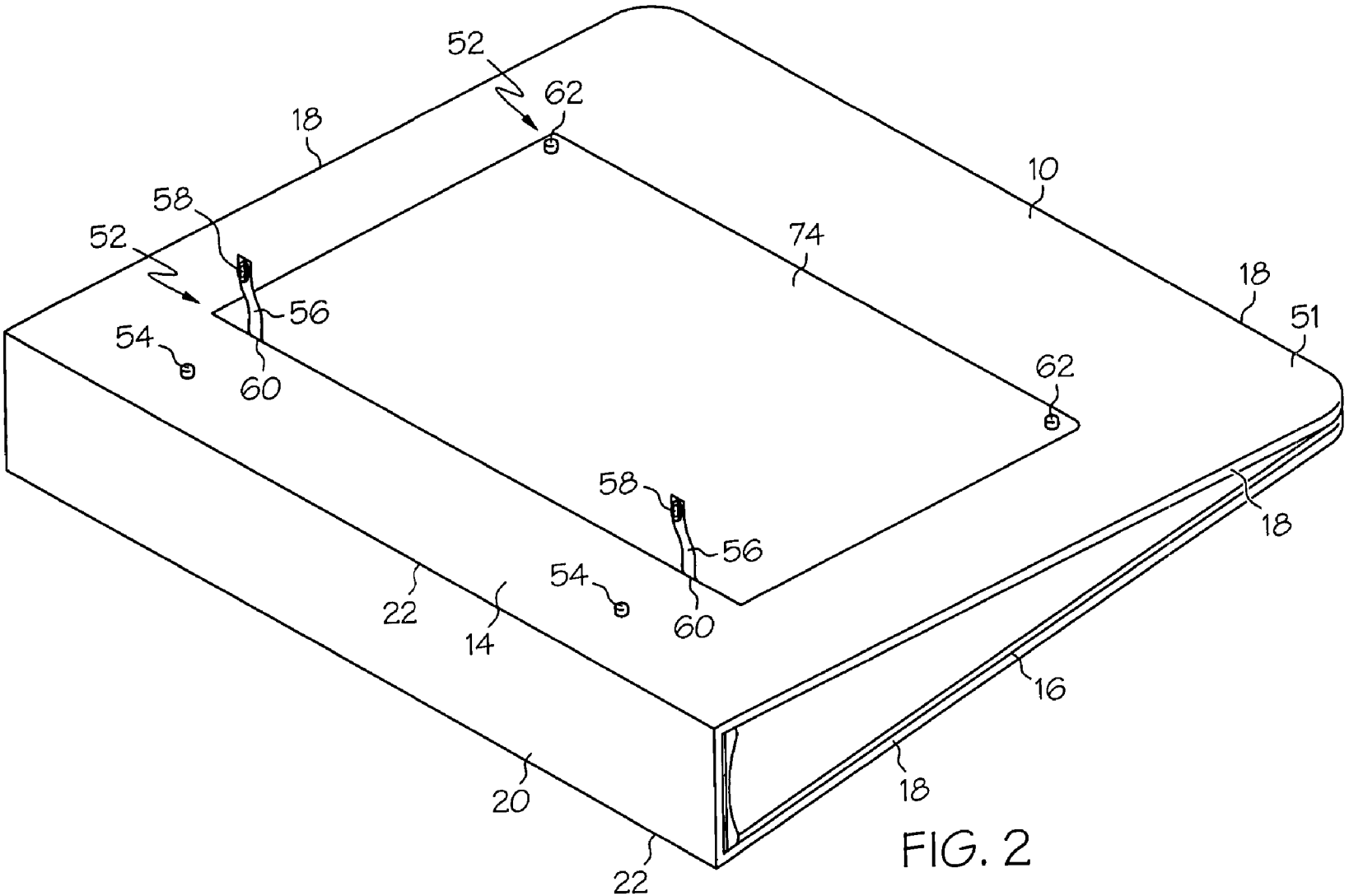
FIG. 2 is a front perspective view of the binder of FIG. 1, with the pouch removed.
Figure 5:
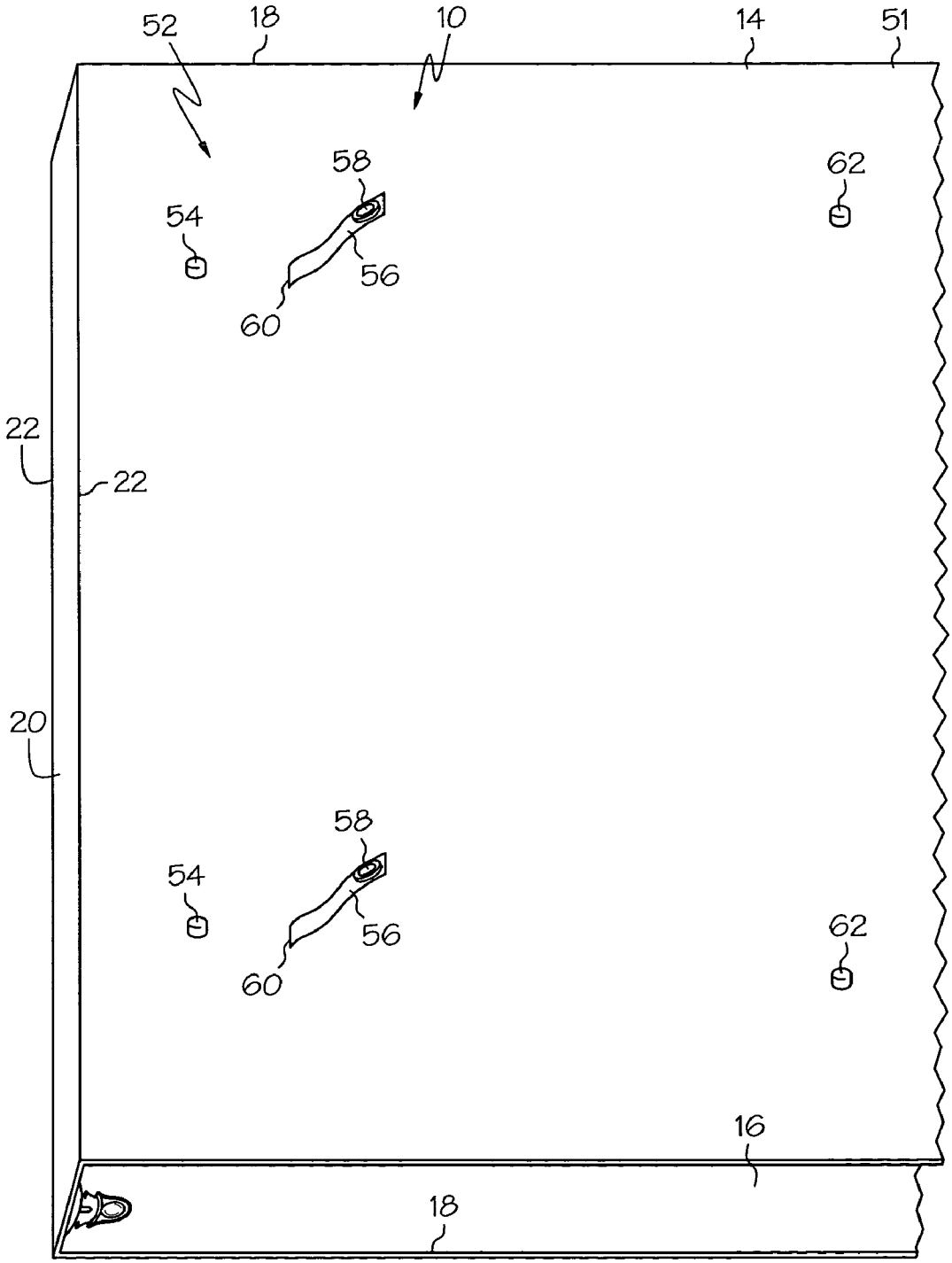
FIG. 5 is a front detail perspective view of the binder of FIG. 2.

As shown in FIGS. 2 and 5, the front cover 14 or outer surface 51 of the binder 10 may include an attachment structure 52 that may be spaced away from the outer perimeter 18 of the binder 10 or front cover 14 and that can cooperate with the pouch 12 to couple the pouch 12 to the outer surface 51 of the binder 10. In particular, in the illustrated embodiment, the attachment structure 52 of the binder 10 may include a pair of inner male snap components 54 and a strap of material 56 located adjacent to each inner male snap component 54. Each strap of material 56 may be a generally thin, flexible and pliable piece of material having a female snap component 58 located at a distal end thereof, and may be coupled to the binder 10 along a stitch line 60. The attachment structure 52 of the body or binder 10 may further include a pair of spaced male outer snap components 62.

Figure 6:
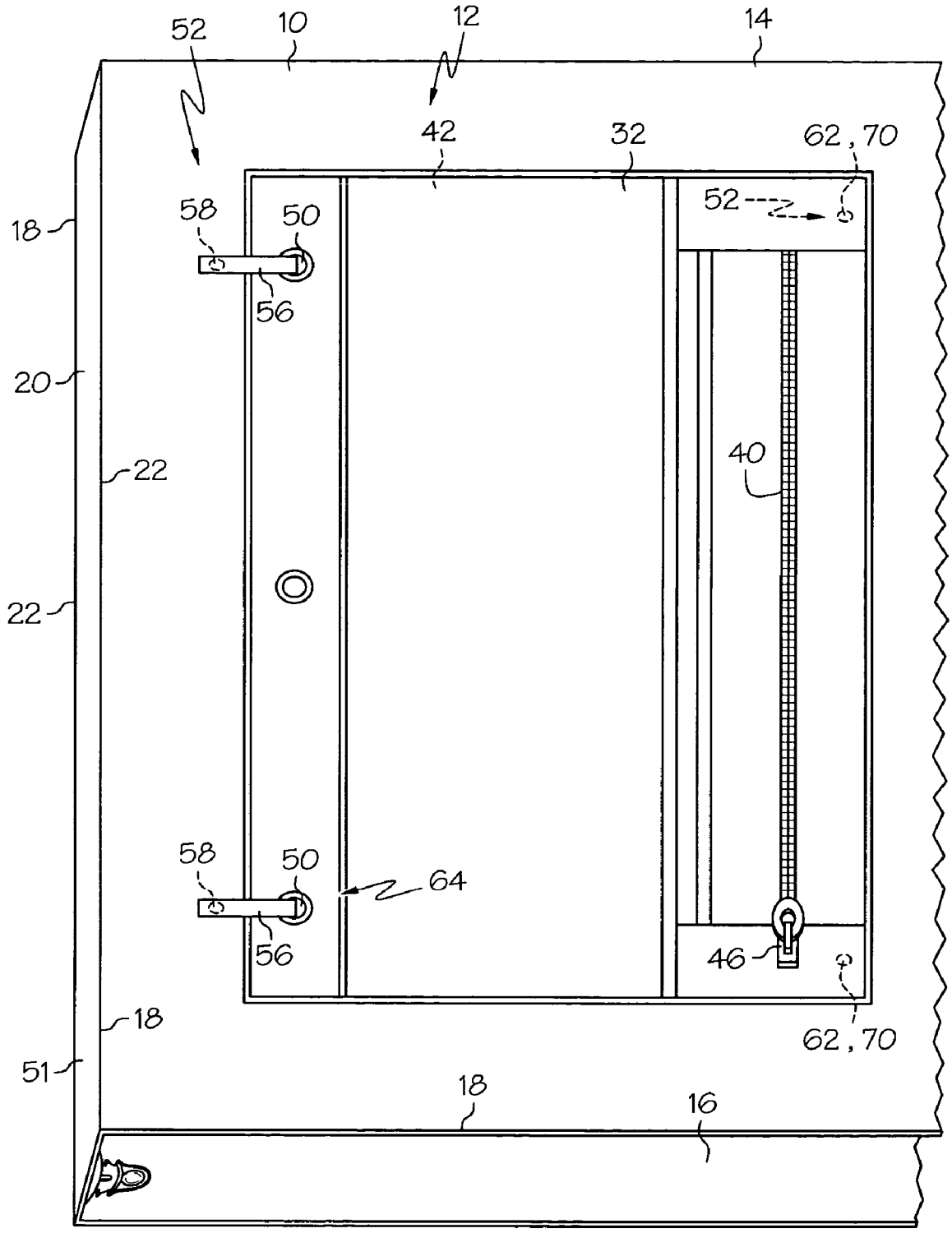
FIG. 6 is a front perspective view of the binder of FIG. 4, with a pouch attached thereto.

The attachment structure 52 of the binder 10 may be shaped to cooperate with the pouch 12, or with attachment structure 64 of the pouch 12, to removably couple the pouch 12 to the outer surface 51 of the binder 10. In particular, as shown in FIGS. 1, 4 and 6, each of the straps of material 56 may be passed through one of the openings 50 of the pouch 12. The female snap components 58 at the end of the straps 56 may then be coupled to the adjacent male snap component 54 such that the straps of material 56 cooperate with the outer surface 10 to form a closed loop.

The pouch 12 may include a set of outer female snap components 70 located on the lower panel 34 and adjacent to the outer corners of the pouch 12. The outer female snap components 70 may be shaped and located to engage the outer male snap components 62 of the binder 10 to further couple the pouch 12 to the binder 10. Thus, in one embodiment the openings 50 and/or female snap components 70 of the pouch 12 may be considered as the attachment structures 64 of the pouch 12.

In this manner, the attachment structures 64, 52 of the pouch 12 and binder 10 can cooperate to releasably attach the pouch 12 to the binder 10. The pouch 12 may be coupled to the binder 10 such that the entirety of the pouch 12 is spaced away from the outer perimeter 18 of the binder 10. In this manner, the pouch 12 may be shaped to be coupled to the binder 10 without any structure that extends around or adjacent to the outer perimeter 18. When the pouch 12 is detachably coupled to the outer surface 51 of the binder 10, the inner cavity 42 and contents of the pouch 12 can be easily accessed. The pouch can also be separated from the binder 10 by separating the inner snap components 54, 58 and outer snap components 62, 70 and pulling the straps 56 through the openings 50. Once separated, the pouch 12 can be used as a stand-alone component, or can be coupled to the binding mechanism 26 of the binder 10 (FIG. 3).

As shown in FIG. 2, the binder 10 may include an area or piece of material 74 having a shape and size similar to the pouch 12 and located underneath the area covered by the pouch 12 when the pouch is coupled to the binder 10. The area 74 (not shown in the remaining figures) may include a fabric, texture, design, or other visual characteristic which is different from the surrounding areas of the front cover 14 of the binder 10 to provide a decorative appearance when the pouch 12 is not coupled to the binder 10.

It should be understood that the male/female orientation of the various snap components disclosed herein may be reversed without departing from the scope of the invention. Furthermore, although the straps of material 56 are illustrated as having only the female snap components 58 located thereon, it should be understood that both of the cooperating male 54 and female 58 snap components may be located on a single strap of material 56. Furthermore, a wide variety of attachment mechanisms besides snaps may be utilized without departing from the scope of the invention. For example, hook and loop fastening materials (such as VELCRO®), clasps, brackets, prongs, magnets, interengaging geometries, clips, ties, cords, zippers, slide fasteners, flaps, etc. may be used for attaching the pouch 12 to the binder 10.

Figure 7:
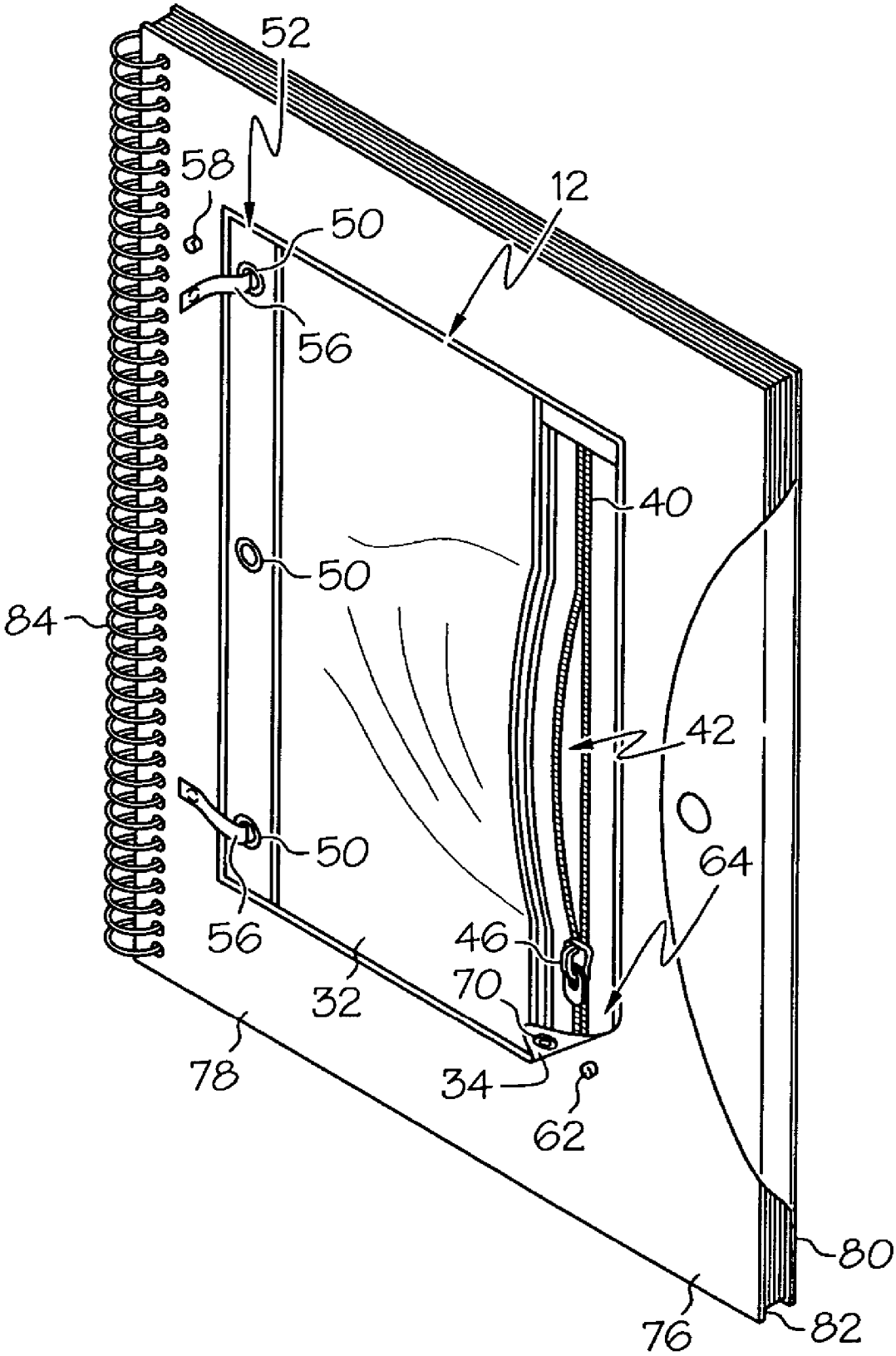
FIG. 7 is a front perspective view of a notebook with a pouch attached thereto.

The system of the present invention may also be implemented in notebooks, folders and other similar devices. For example, FIG. 7 illustrates the pouch 12 coupled to the front cover 76 of a notebook 78. In the illustrated embodiment, the notebook 78 includes front 76 and rear 80 covers with a set of papers 82 located therebetween. The front 76 and rear 80 covers and set of papers 82 may be bound together by a binding mechanism 84, such as a coil binding mechanism, spiral binding mechanism, adhesive binding mechanism or the like. In FIG. 7 the upper one of the straps 56 is not coupled to the snap component 58 to illustrate the snap component.

Figure 8:
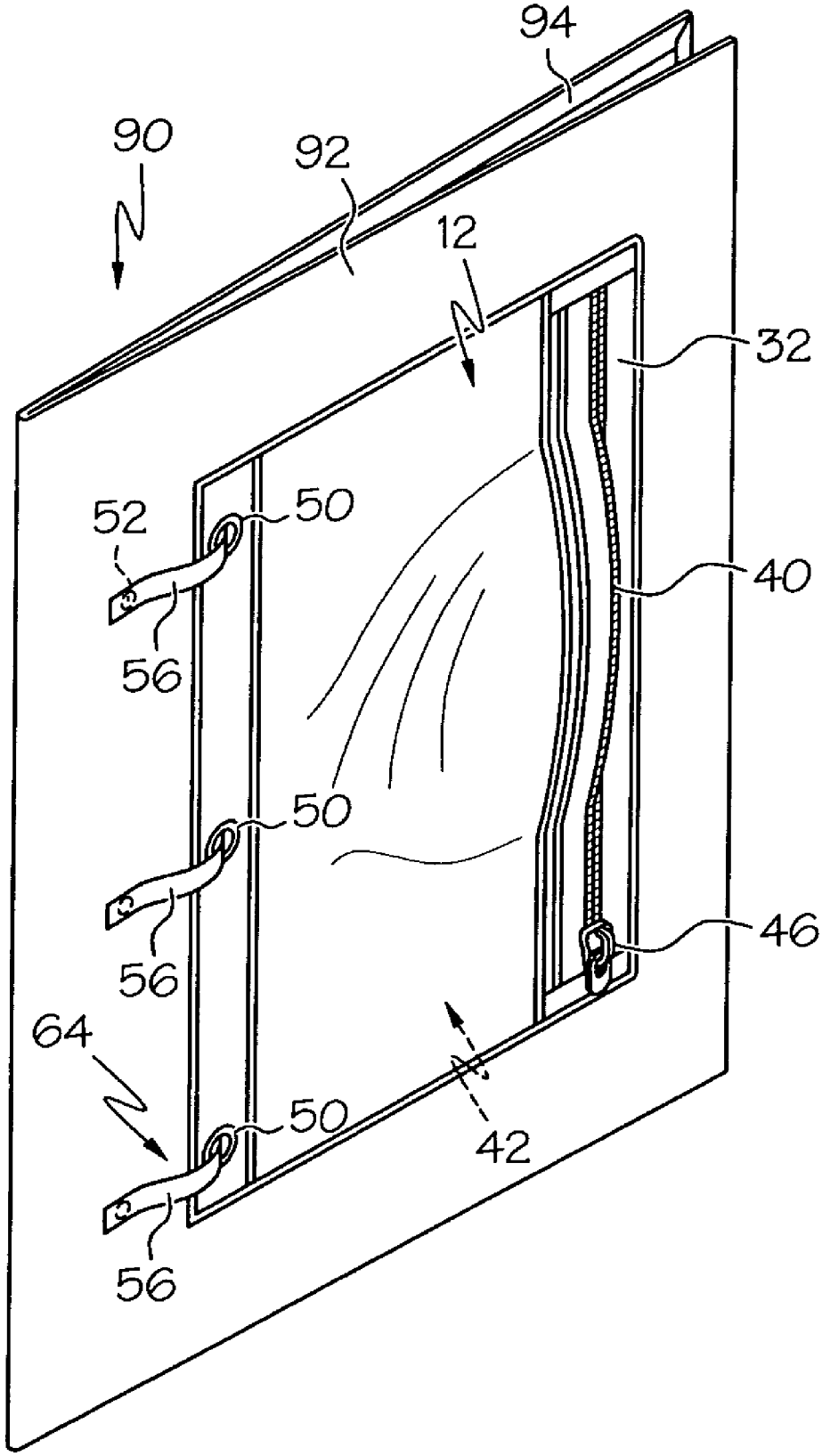
FIG. 8 is a front perspective view of a folder with a pouch attached thereto.

FIG. 8 illustrates the pouch 12 coupled to the front surface of a folder 90, wherein the folder 90 includes front 92 and rear 94 covers which are directly coupled together. Each of the covers 92, 94 may include a pocket located on an inner surface thereof for storing loose papers and the like. As shown in FIG. 8, the body or folder 90 may include three straps 56, each of which is located and configured to fit through an opening 50.

Having described the invention in detail and by reference to the preferred embodiments, it will be apparent that modifications and variations thereof are possible without departing from the scope of the invention.

What is claimed is:

1. A body and pouch combination comprising:

a body having a front cover and a rear cover pivotally coupled together, said front cover having a generally flat, planar outer surface having a body attachment structure located thereon; and a pouch that can cooperate with said body attachment structure to removably attach said pouch to said outer surface, said pouch having an inner storage cavity, and wherein said pouch includes at least one opening formed therein, and wherein body attachment structure can cooperate said at least one opening to couple said pouch to said outer surface.

2. The body and pouch combination of claim 1 further comprising a binding mechanism coupled to said body.

3. The combination of claim 1 wherein said body attachment structure includes a strip of material which can be releasably attached to itself or to said body.

4. The combination of claim 1 wherein said pouch includes a pouch attachment structure that can cooperate with said body attachment structure to couple said pouch to said outer surface.

5. The combination of claim 1 wherein said body includes an outer perimeter, and wherein said body attachment structure is spaced away from said outer perimeter.

6. The combination of claim 1 wherein said body includes an outer perimeter, and wherein said pouch is attachable to said body such that the entirety of said pouch is spaced apart from said outer perimeter.

7. The combination of claim 1 wherein said body includes an outer perimeter and wherein said pouch is attachable to said body without any structure that extends around or adjacent to said outer perimeter.

8. The combination of claim 1 wherein said pouch is shaped to be coupled to a three ring binding mechanism.

9. The combination of claim 1 wherein said body includes a three ring binding mechanism, and wherein said pouch includes three spaced openings formed therein, each of said openings being sized and located to receive a ring of a three ring binding mechanism therethrough.

10. The combination of claim 1 wherein body includes a spine located between and coupled to said front and rear covers, and wherein each of said front and rear covers are pivotally coupled to said spine.

11. The combination of claim 1 wherein each of said front and rear covers are generally flat and rectangular in front view.

12. The combination of claim 1 wherein said front and rear covers are generally aligned and each includes an inner edge, and wherein said front and rear covers are coupled along their inner edges.

13. The combination of claim 1 wherein said body is movable between a closed position wherein said front and rear covers are generally aligned, parallel and facing each other, and an open position wherein said front and rear covers are generally not facing each other.

14. The combination of claim 1 wherein said front and rear covers are directly coupled together.

15. The combination of claim 1 wherein said pouch includes a front panel and a rear panel directly coupled together to form said cavity therebetween.

16. The combination of claim 1 wherein said pouch includes an access opening for providing access to said inner cavity and a fastener for selectively opening and closing said access opening.

17. The combination of claim 1 wherein said pouch has a surface area of greater that about ¼ of the surface area of one of said covers.

18. The combination of claim 1 wherein said pouch includes at least three spaced openings, each being located to receive a ring of a three ring binder therethrough, and wherein said at least one opening is one of said three spaced openings.

19. The combination of claim 1 wherein said body attachment structure includes a strip of material which can be passed through said opening and releasably attached itself or to said body.

20. The combination of claim 1 wherein said pouch is directly removably attachable to said outer surface.

21. The combination of claim 2 wherein said binding mechanism is a three-ring binding mechanism or a prong binding mechanism.

22. The combination of claim 2 wherein said binding mechanism joins said front and rear covers together.

23. The combination of claim 2 wherein said body is movable between a closed position wherein said front and rear covers generally block access to said binding mechanism and an open position wherein said front and rear covers do not block access to said binding mechanism.

24. The combination of claim 4 wherein said body and pouch attachment structures include male and female snap components.

25. A body and pouch combination comprising:

a body having a front cover and a rear cover pivotally coupled together, said body having an outer surface and an outer perimeter; and a pouch removably attachable to said outer surface such that the entirety of said pouch is spaced away from said outer perimeter, said pouch having an inner storage cavity, and wherein said body includes a body attachment structure located on said outer surface that can cooperate with said pouch to couple said pouch to said outer surface and wherein said pouch includes at least one opening formed therein, and wherein said body attachment structure can cooperate with said at least one opening to couple said pouch to said outer surface.

26. The combination of claim 25 wherein said pouch includes at least three spaced openings, each being located to receive a ring of a three ring binder therethrough, and wherein said at least one opening is one of said three spaced openings.

27. The combination of claim 25 wherein said body includes a body attachment structure located on said outer surface that can cooperate with said pouch to couple said pouch to said outer surface and wherein said body attachment structure includes a strip of material which can be passed through said opening and releasably attached itself or to said body.

* * * * *